United States Patent [19]

Harris

[11] 4,183,519

[45] Jan. 15, 1980

[54] SHEET REGISTRATION MECHANISM

[75] Inventor: Willard C. Harris, Rochester, N.Y.

[73] Assignee: Eastman Kodak Company, Rochester, N.Y.

[21] Appl. No.: 935,272

[22] Filed: Aug. 21, 1978

[51] Int. Cl.[2] ..... B65H 9/04

[52] U.S. Cl. ..... 271/245

[58] Field of Search ..... 271/243, 244, 245

[56] References Cited

U.S. PATENT DOCUMENTS

| | | | |
|---|---|---|---|
| 986,726 | 3/1911 | Batt | 271/245 |
| 2,605,103 | 7/1952 | Backhouse . | |
| 2,613,930 | 10/1952 | Backhouse . | |
| 3,006,637 | 10/1961 | Backhouse . | |
| 3,080,163 | 3/1963 | Pasquinelli . | |
| 3,173,685 | 3/1965 | Backhouse . | |
| 3,747,918 | 7/1973 | Margulis . | |
| 3,844,552 | 10/1974 | Bleau . | |
| 3,910,570 | 10/1975 | Bleau . | |
| 3,992,002 | 11/1976 | Fassman . | |
| 4,060,230 | 11/1977 | Church | 271/244 X |

FOREIGN PATENT DOCUMENTS 1492466 11/1977 United Kingdom .

*Primary Examiner*—Richard A. Schacher
*Attorney, Agent, or Firm*—G. Herman Childress

[57] ABSTRACT

A document sheet registration mechanism is located on a copier adjacent a platen. The mechanism has a pair of registration members connected to a shaft by a pair of levers so that the members are moved in response to rotation of the shaft. Each member has a flat upper surface and a registration surface that is perpendicular to the upper surface. The registration members are movable by the shaft between (1) a registration position wherein the registration edges project above the platen surface for engagement by a document sheet and (2) a release position wherein the registration edges are beside the platen surface and the upper surfaces of the members are substantially coplanar with the platen so that a sheet can be driven from the platen across the upper surfaces of the members.

6 Claims, 4 Drawing Figures

SHEET REGISTRATION MECHANISM

BACKGROUND OF THE INVENTION

1. Field of the Invention

This invention relates generally to sheet registration mechanisms and, more specifically, to a sheet registration mechanism for copier apparatus. The sheet registration mechanism of the invention is used for locating a document sheet on a platen during any one of several possible modes of operation, including feeding of sheets once or twice to a platen for copying one or both sides thereof, in a document positioner mode in which sheets are not recirculated but are fed once to the platen for copying, and in a manual mode of operation wherein the registration mechanism provides an edge for manual alignment of a document sheet on the platen for copying.

2. Description of the Prior Art

Document and copy sheet registration mechanisms are well known in the art. In some instances these mechanisms have been provided in connection with document feeding apparatus so that a document can be fed to the platen of a copier and the registration mechanism will properly position the document on the platen for exposure by the copier. Typical disclosures of this type of apparatus are found in U.S. Pat. Nos. 3,747,918; 3,844,552; 3,910,570 and 3,992,002. It is also known to provide sheet registration mechanisms that pivot between a registration position wherein the mechanism engages a sheet from a position above the surface on which a sheet travels and a second position spaced from the surface to allow passage of the sheet after registration. Typical disclosures of this type of apparatus are found in U.S. Pat. Nos. 986,726; 2,605,103; 2,613,930; 3,006,637; 3,080,163 and 3,173,685.

Some models of the EKTAPRINT Copier/Duplicator (manufactured by the assignee of the present invention) comprise an automatic document feeder generally as shown in British Pat. No. 1,492,466. In these models a registration mechanism is manually moved to a registration position when documents are to be manually placed on the platen for copying. The registration mechanism is manually pivoted away from the platen before the recirculating document feeder is swung to its operative position over the platen. The recirculating feeder includes a pair of registration feet that move downwardly into engagement with the platen for stopping and registering document sheets fed to the platen by the recirculating feeder. Thus two separate registration mechanisms are provided, one for manual feeding and another for automatic feeding of document sheets to the platen. Also one mechanism is located on the copier and the other is located on the feeding mechanism. Operator intervention is required to change from manual to automatic registration modes.

In some instances it is desireable to feed document sheets to the platen from each of two directions as, for example, disclosed in the commonly assigned U.S. patent application Ser. No. 923,874 filed July 12, 1978 in the names of R. Holzhauser et al and entitled SHEET FEEDING APPARATUS FOR USE WITH COPIER/DUPLICATOR OR THE LIKE. Using the apparatus disclosed in that application, document sheets can be fed to the platen first in one direction and then the opposite direction for copying both sides of the document sheets, and sheets are fed to the platen in one direction only for copying only one side of document sheets. When copying simplex (one sided) originals or duplex (two sided) originals, the sheets are registered by a mechanism located in the sheet feeder. When the feeding apparatus is swung out of the way for copying by manually placing a sheet on the platen, the registration mechanism is no longer available for use. Thus a separate manual registration mechanism should be provided and positioned so that it does not interfere with sheets when they are automatically circulated along the various paper paths.

In view of the foregoing it will be seen that it is very desireable to have an automatic sheet registration mechanism which requires no manipulation by an operator in order to change between various modes of operation, including a simplex mode, a duplex mode, a document positioner mode and a manual mode, and also to have such a mechanism fixed on the copier with respect to the platen for ease of alignment.

SUMMARY OF THE INVENTION

In accordance with the present invention a mechanism is provided for registering an edge of a document sheet relative to a surface of a platen in a copying apparatus. The mechanism comprises a registration member that has an upper surface and a registration edge located at an angle to the upper surface. Means are provided for positioning the registration member in a first or registration position wherein the upper surface of the registration member is above the platen's surface and the registration edges engages the platen surface to register the document sheet on the platen, and a second or release position wherein the registration edge is removed from the platen surface and the upper surface of the registration member is along side the platen surface to form a continuation thereof so that a document sheet can be advanced across the upper surface as it is moved relative to the platen surface. Means are provided for moving the registration member to and from its two positions.

The invention, and its objects and advantages, will become more apparent in the detailed description of the preferred embodiments presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENTS

Figure 1:
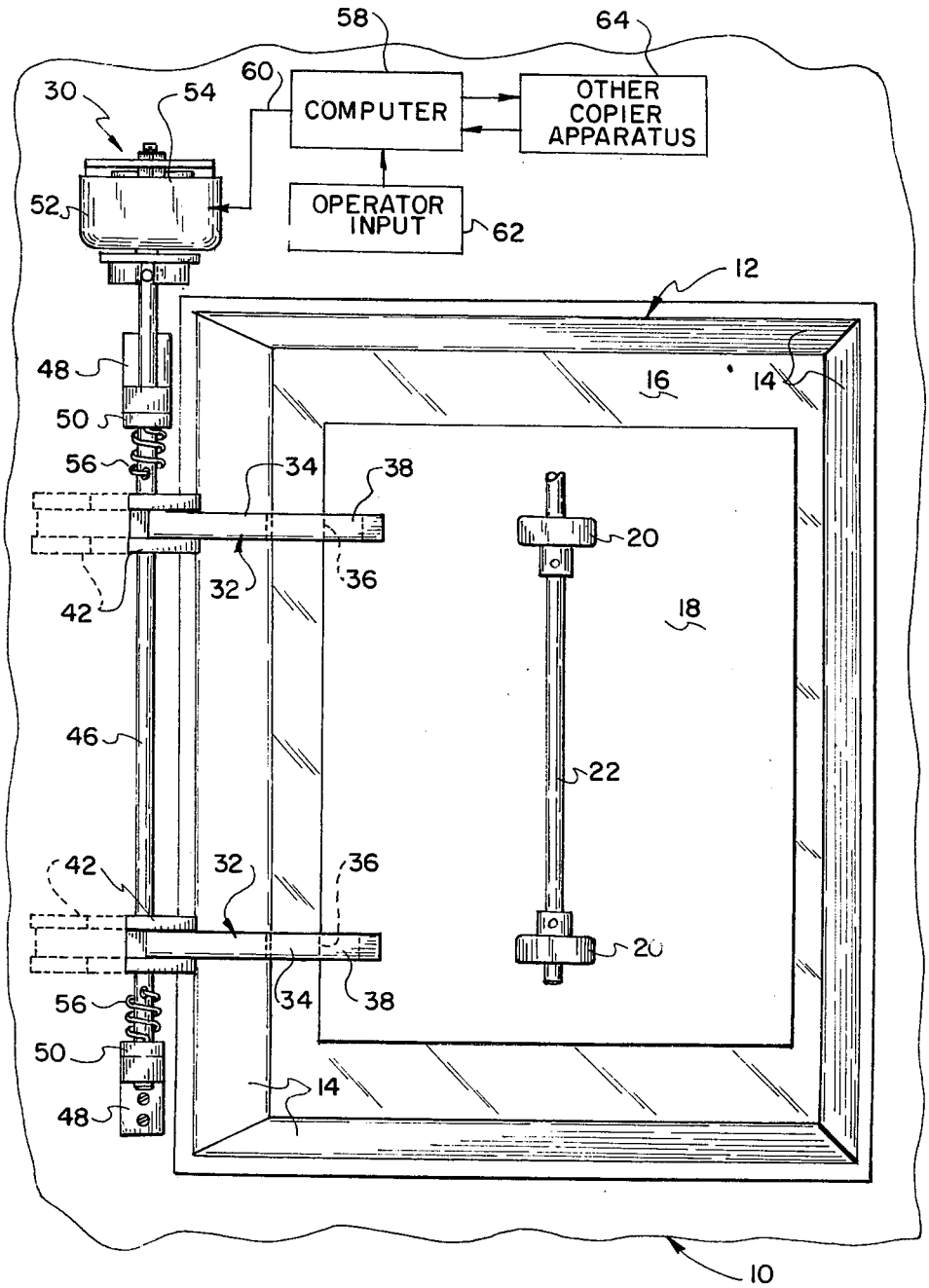
FIG. 1 is a plan view of a registration mechanism of the invention shown mounted adjacent a platen of a copier/duplicator or the like, and showing a document sheet located on the platen surface by the registration mechanism.

Referring now to the drawings in detail, a copier/duplicator or the like is partially shown at 10 and includes a generally rectangular glass platen 12 having around its periphery beveled edge surfaces designed 14 that taper downwardly and outwardly away from a flat upper surface 16 of the platen. A rectangular document sheet 18 is shown positioned on the platen in a position for copying in FIGS. 1–3. The side of the sheet facing downwardly is copied while it is on the platen in a manner known in the art. The document sheet can be manually positioned on the platen 12 for copying or it can be automatically driven onto the platen and away from the platen copying position by means of recirculating feeder apparatus or document positioner apparatus as disclosed in the beforementioned British Pat. No. 1,492,466 and in the copending Application Ser. No. 923,874 filed in the names of R. Holzhauser, et al. Thus drive rollers 20 mounted on shaft 22 may comprise part of the apparatus for feeding document sheets into the registration position on the copier platen and away from the registration position. Typically two pair of rollers 20 on two shafts 22 are provided for the recirculating document feeder structures illustrated in the beforementioned British Patent and the copending application. The drive rollers are swung away from the illustrated position over the copier platen when document sheets are manually positioned on the platen for copying.

Figure 4:
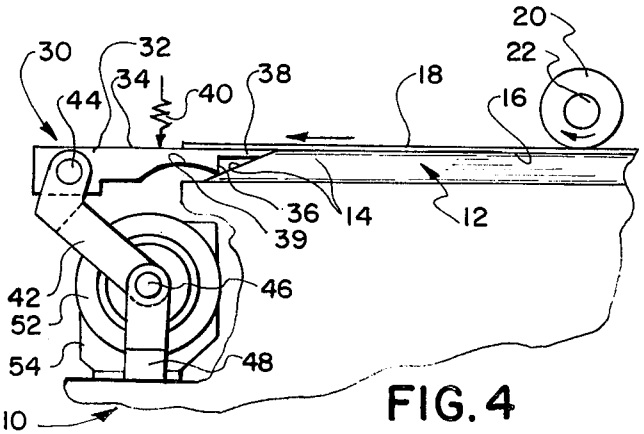
FIG. 4 is a view similar to FIG. 3 but showing the registration mechanism in its second or release position.
Figure 3:
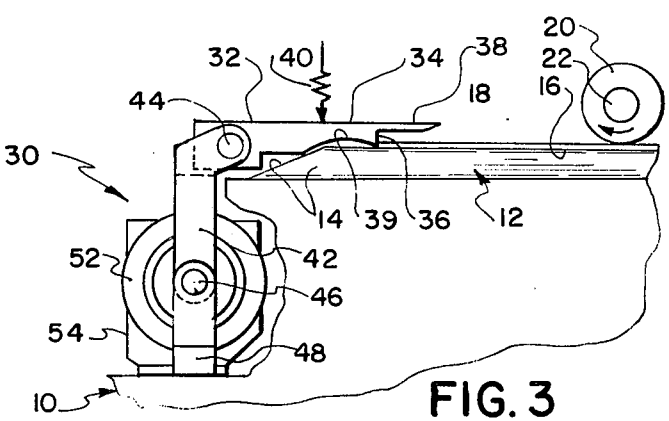
FIG. 3 is an end view taken from the right end of FIG. 2 and showing the registration mechanism in its registration position.

The registration mechanism of the present invention is generally designated 30 and comprises a pair of identical elongate registration members 32. As best illustrated in FIGS. 3 and 4, each member 32 has an upper flat surface 34 and a flat registration edge surface 36 that is substantially perpendicular to surface 34 and platen surface 16. Edges 36 are located near but spaced from one end portion of the registration members to provide a projecting, finger-like end portion 38 that overlies the upper surface 16 of platen 12. This projecting portion reduces the possibilty that a document sheet being driven against the registration edges 36 will lift up over the registration members and travel along the upper surfaces 34 thereof. Where this is not a problem the projecting portion 38 can be eliminated and the edge surface 36 can be extended upwardly to meet surface 34.

Each registration member has an arcuate surface 39 extending from the lower end of edge 36 toward the other end portion of the registration member. When the members 32 are in the position shown in FIG. 3, the left end of surface 39 is above the beveled edge 14 of the platen. As the members 32 move between their FIG. 3 position and FIG. 4 position, surface 39 remains above the platen, and the edge defined by surfaces 36 and 39 rides along the platen.

The registration members preferably are urged downwardly against the platen by suitable biasing forces diagrammatically shown at 40. This holds the registration members against the platen so that a sheet can engage the edges 36 during registration of the sheet and so that the upper surface 34 of the members will be positioned properly with respect to platen surface 18 when the sheet is being removed from the platen.

The registration members are mounted for movement between a registration position (FIG. 3) and a release position (FIG. 4) by two levers 42 which have their upper ends connected to the registration members by hinge pins 44 that extend through the end portion of each registration member opposite from the registration edge 36. The lower end portion of each lever is rigidly secured to a shaft 46 which is rotatably mounted on the copier apparatus 10 by a pair of brackets 48 and bushings 50. The bushings are secured to the brackets and support the shaft.

A rotary solenoid 52 is mounted on the copier by a bracket 54 and is coupled to shaft 46 so that when the solenoid is energized the shaft is rotated in one direction. The shaft is rotated in the opposite direction by a pair of springs 56 that are coiled aroung the shaft 46. Each spring has one end portion thereof secured to the bushing 50 so that it remains stationary while the other end portion of the spring is secured to the shaft 46 so that it rotates with the shaft under the influence of the solenoid 52. Thus when the solenoid is deenergized the spring returns the shaft in a second direction opposite to its direction of movement as induced by the solenoid. Suitable stops (not shown) can be provided for limiting the extent of rotary movement of the shaft in either direction.

Figure 2:
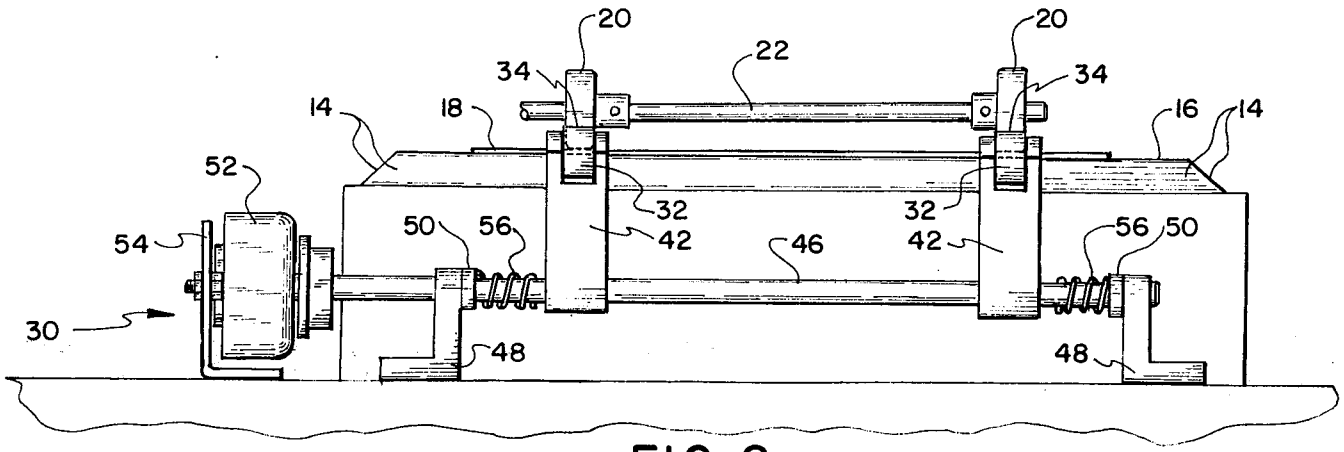
FIG. 2 is an elevational view taken from the left side of FIG. 1.

While the solenoid 52 could be energized by the operator to effect movement of the shaft and thus the registration members, it is preferred that operation of the solenoid be automatically coordinated with related functions of the copier apparatus. Therefore, as illustrated in FIG. 1, the solenoid preferably is coupled to a computer 58 by a lead line 60. The computer can form part of a microprocessor in the copier 10 or be part of the feeder. The computer receives input data from the operator by means diagrammatically shown at 62 and which, for example, may comprise a keyboard. Similarly, the computer receives and sends signals to other copier apparatus generally designated 64. For a more complete description of the computer and the manner in which it operates various portions of the copier apparatus, reference is made to commonly assigned U.S. Pat. No. 3,914,047 which issued on Oct. 21, 1975 in the names of W. E. Hunt, Jr., et al. and is entitled SYNCHRONIZING CONTROL APPARATUS FOR ELECTROPHOTOGRAPHIC APPARATUS UTILIZING DIGITAL COMPUTER. It is understood that the computer is programmed for the various possible modes of operation, and that the operator can input data to the computer by means shown at 62 to indicate the mode of operation desired for any particular copier operation, the number of copies requested, etc.

In each of the various modes of operation the position of the registration members 32 is under control of the computer, which in turn controls the solenoid 52. Thus when the operator input at 62 indicates to the computer that the manual mode of operation is required, the computer operates the solenoid to move shaft 46 clockwise (as viewed in FIGS. 3 and 4) to bring registration members 32 to the position shown in FIG. 3 wherein the edges 36 are located above the surface 16 of the platen 12 and the edges 34 are above the platen surface. At this time the drive rollers 20 have been moved away from the platen so that the operator has access to the platen surface. The operator then places the document sheet 18 on the platen surface 16 with the face of the document sheet to be copied facing downwardly. The document sheet is then moved against the edges 36 of the registration members. When the document sheet is in position against both edges 36, the operator signals the computer to proceed with the usual copying operations, resulting in lamps (not shown) illuminating the document and effecting copying thereof in a known manner. After the desired number of copies have been made the operator removes the document sheet 18 from the platen and can then register one or more additional document sheets for copying.

When the operator input to the computer indicates that the machine is to operate in the automatic mode of operation and that one side only of a document sheet is to be copied, the registration member initially is moved to the registration position shown in FIG. 3. Then the document sheet is driven onto the platen and aginst the edges 36 of the two registration members 32 by means of rollers 20 (and other apparatus not shown). The rollers 20 preferably continue to rotate against the upper surface of the document sheet so that the sheet is firmly positioned against both edges 36 and to eliminate any skew in the document sheet relative to the platen. When the document sheet is registered on the platen, the computer signals the other copier apparatus to proceed with copying of the document sheet in the usual manner.

After the document sheet has been copied once (or the required number of times), the registration members 32 are moved to their respective release positions shown at FIG. 4 wherein the registration edges 36 are removed from the platen surface 16 and the upper surfaces 34 of both registration members are located along side the platen surface 16 to form a continuation thereof. At this time the lower end of registration edges 36 and the end portions 38 of the registration members are located along the beveled edge 14 of the platen. Then the continued rotation of drive rollers 22 removes the sheet over the upper surfaces 34 of the registration members as illustrated in FIG. 4. The registration members 32 are moved to their release positions very rapidly so that the leading edge of the sheet is not trapped by end portions 38 of the members. After the sheet has passed over the registration members the computer can again return the registration members to their registration position, shown in FIG. 3, so that the next document sheet can be advanced onto the platen and then registered for copying.

Registration apparatus of the present invention can also be used with duplex document feeding apparatus of the type disclosed in the aforementioned copending U.S. Patent Application entitled SHEET FEEDING APPARATUS FOR USE WITH COPIER/DUPLICATOR OR THE LIKE filed in the names of R. Holzhauser et al. In that apparatus one side of a document sheet is copied in the manner previously explained. Then the sheet is driven from the platen in the direction shown by the arrow in FIG. 4, through a turn around device (not shown) which inverts the sheet, and then back onto the platen while traveling from left to right as viewed in FIGS. 3 and 4. The document sheet is then reversed and again registered, this time with the second face of the document sheet facing downwardly on the platen. Then the second side of the document sheet is copied, and the document sheet is again removed from the platen by advancing it in the direction as shown by the arrow in FIG. 4. When the registration mechanism 30 of the invention is used for duplex copying in this manner, the registration mechanism remains in its lowered position while the document sheet is removed from the platen, inverted and returned to the platen. Then the registration mechanism is again moved to its registration position, shown in FIG. 3, the document sheet is brought into registration position in engagement with the edges 36 of the registration members, and the second side of the document sheet is copied. Next the registration mechanism 30 is moved to its release position, shown in FIG. 4, and the document sheet is again driven in the direction shown by the arrows off the platen.

In each of the various modes of operation described for the apparatus of the invention, it will be seen that the operator does not need to manually move the registration mechanism into either its release position or its registration position whether the copying is being done in a manual mode or any one of the various automatic modes described. The operator simply provides the required input to the computer and it controls the rotational position of the shaft 46 by energizing or deenergizing the solenoid 52. This elimination of operator positioning of the registration member not only simplifies the operation but may eliminate service calls where the operator does not realize that the registration mechanism is improperly positioned for the mode of operation being attempted. In addition, the registration mechanism, by being located on the copier itself and not on a recirculating document feeder, is usable for all modes of operation, even in manual or document feeder mode of operation, and the usual registration mechanism associated with a document feeder can be eliminated. Moreover, this positioning of the registration mechanism on the copier/duplicator simplifies alignment of the mechanism and increases the accuracy of its registration function.

The invention has been described in detail with particular reference to preferred embodiments thereof, but it will be understood that variations and modifications can be effected within the spirit and scope of the invention.

I claim:

1. A mechanism for registering an edge of a document sheet relative to a surface of a platen in a copying apparatus, the mechanism comprising:

a registration member having an upper surface and a registration edge located at an angle to the upper surface;

means for positioning said registration member in (1) a first position wherein the upper surface is above the platen surface and the registration edge extends to the platen surface to register a document sheet on the platen and (2) a release position wherein the registration edge is separated from the platen surface and the upper surface is adjacent to the platen surface to form a continuation thereof so that a document sheet can be advanced across the upper surface as it is moved relative to the platen surface; and means for moving said member to and from the respective positions.

2. The invention as set forth in claim 1 wherein siad moving means comprises a rotatable shaft and a solenoid coupled to said shaft for rotating the shaft, and the invention further comprising means for urging the registration member toward the platen surface when said member is in its first position.

3. A registration mechanism for locating an edge of a document sheet relative to a flat surface of a platen in a copying apparatus, the mechanism comprising:

a shaft mounted for rotational movement in a first direction and in a second direction;

means for selectively rotating said shaft in its first and second directions;

a plurality of elongate registration members, each of said members having an upper flat surface and a registration edge comprising a flat surface that is substantially perpendicular to the upper surface and located at one end portion of the member, each of said registration members being movable between (1) a first position wherein the upper surface is above the platen surface and the registration edge extends to the platen surface to register a document sheet on the platen and (2) a second position wherein the registration edge is separated from the platen surface and the upper surface is beside the platen surface and substantially coplanar with the platen surface to form a continuation thereof so that a document sheet can be advanced across the upper surface as it is moved relative to the platen surface; and means for coupling said registration members to the shaft so that the registration members are moved to their respective first positions in response to movement of the shaft in the first direction and the registration members are moved to their respective second positions in response to movement of the shaft in the second direction.

4. The invention as set forth in claim 3 wherein said coupling means comprises a plurality of levers secured to said shaft for simultaneous rotation therewith, each of said registration members being pivotally connected to one of said levers.

5. The invention as set forth in claim 3 further comprising means for urging each of said registration members toward the platen surface when said members are in their respective first positions.

6. The invention as set forth in claim 3 wherein said rotating means comprises a solenoid coupled to said shaft and the invention further comprising programmable control means connected to said solenoid for controlling its operation in a predetermined sequence.

* * * * *

Disclaimer 4,183,519.—*Willard Chester Harris*, Rochester, N.Y. SHEET REGISTRATION MECHANISM. Patent dated Jan. 15, 1980. Disclaimer filed June 16, 1980, by the assignee, *Eastman Kodak Company*.

Hereby enters this disclaimer to claims 1 and 2 of said patent.

[*Official Gazette August 5, 1980.*]